US010836190B2

(12) United States Patent
Miyazaki

(10) Patent No.: US 10,836,190 B2
(45) Date of Patent: Nov. 17, 2020

(54) HEAD MODULE, HEAD DEVICE, AND LIQUID DISCHARGE APPARATUS

(71) Applicant: Takeshi Miyazaki, Kanagawa (JP)

(72) Inventor: Takeshi Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/200,894

(22) Filed: Nov. 27, 2018

(65) Prior Publication Data

US 2019/0263157 A1 Aug. 29, 2019

(30) Foreign Application Priority Data

Feb. 24, 2018 (JP) ..... 2018-031398
Oct. 11, 2018 (JP) ..... 2018-192858

(51) Int. Cl.
*B41J 29/377* (2006.01)
*B41J 2/165* (2006.01)
*B41J 29/02* (2006.01)

(52) U.S. Cl.
CPC ..... *B41J 29/377* (2013.01); *B41J 2/165* (2013.01); *B41J 29/02* (2013.01)

(58) Field of Classification Search
CPC ..... B41J 2202/20; B41J 2002/14362; B41J 2202/21; B41J 29/377; B41J 2/155; B41J 2002/14419; B41J 2202/08; B41J 29/02; B41J 2202/19; B41J 2/04515; B41J 29/38; B41J 2/165
See application file for complete search history.

(56) References Cited

U.S. PATENT DOCUMENTS

2018/0029362 A1* 2/2018 Sugiura ..... B41J 2/1408

FOREIGN PATENT DOCUMENTS

| | | |
|---|---|---|
| JP | 2006-181975 | 7/2006 |
| JP | 2006-321171 | 11/2006 |
| JP | 2010-274393 | 12/2010 |
| JP | 2013-082145 | 5/2013 |
| JP | 2013-139157 | 7/2013 |

* cited by examiner

*Primary Examiner* — Jannelle M Lebron
(74) *Attorney, Agent, or Firm* — Harness, Dickey & Pierce, P.L.C.

(57) ABSTRACT

A head module includes a base, a plurality of heads mounted on the base, a plurality of wiring members connected to the plurality of heads, the plurality of wiring members mounting a plurality of drive circuits, respectively, and a heat dissipation member thermally coupled to the plurality of drive circuits. The heat dissipation member is disposed facing the plurality of heads and the base, and the heat dissipation member contacts the base at a position between adjacent heads of the plurality of heads.

26 Claims, 12 Drawing Sheets

HEAD MODULE, HEAD DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-031398, filed on Feb. 24, 2018, and Japanese Patent Application No. 2018-192858, filed on Oct. 11, 2018, in the Japan Patent Office, the entire disclosure of each of which is hereby incorporated by reference herein.

BACKGROUND

Technical Field

An aspect of the present disclosure relates to a head module, a head device, and a liquid discharge apparatus.

Related Art

A head module is formed by attaching a liquid discharge head to a base, in which the liquid discharge head is supported by a resin holder on which a plurality of protrusions is formed. A reinforcing member is disposed above the liquid discharge head with the resin holder interposed between the reinforcing member and the liquid discharge head. The reinforcing member is a metal plate having a U-shaped cross section, and functions as a heat sink. The reinforcing member is in point contact with the plurality of protrusions of the resin holder.

SUMMARY

In an aspect of this disclosure, a novel head module includes a base, a plurality, of heads mounted on the base, a plurality of wiring members connected to the plurality of heads, the plurality of wiring members mounting a plurality of drive circuits, respectively, and a heat dissipation member thermally coupled to the plurality of drive circuits. The heat dissipation member is disposed facing both the plurality of heads and the base and contacts the base at a position between adjacent heads of the plurality of heads.

In another aspect of this disclosure, a head module includes a base, a plurality of heads mounted on the base, a plurality of wiring members connected to the plurality of heads, the plurality of wiring members mounting a plurality of drive circuits, respectively, and a metal member thermally coupled to the plurality of drive circuits. The metal member is disposed facing the plurality of heads and the base, and the metal member contacts the base at a position between adjacent heads of the plurality of heads.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
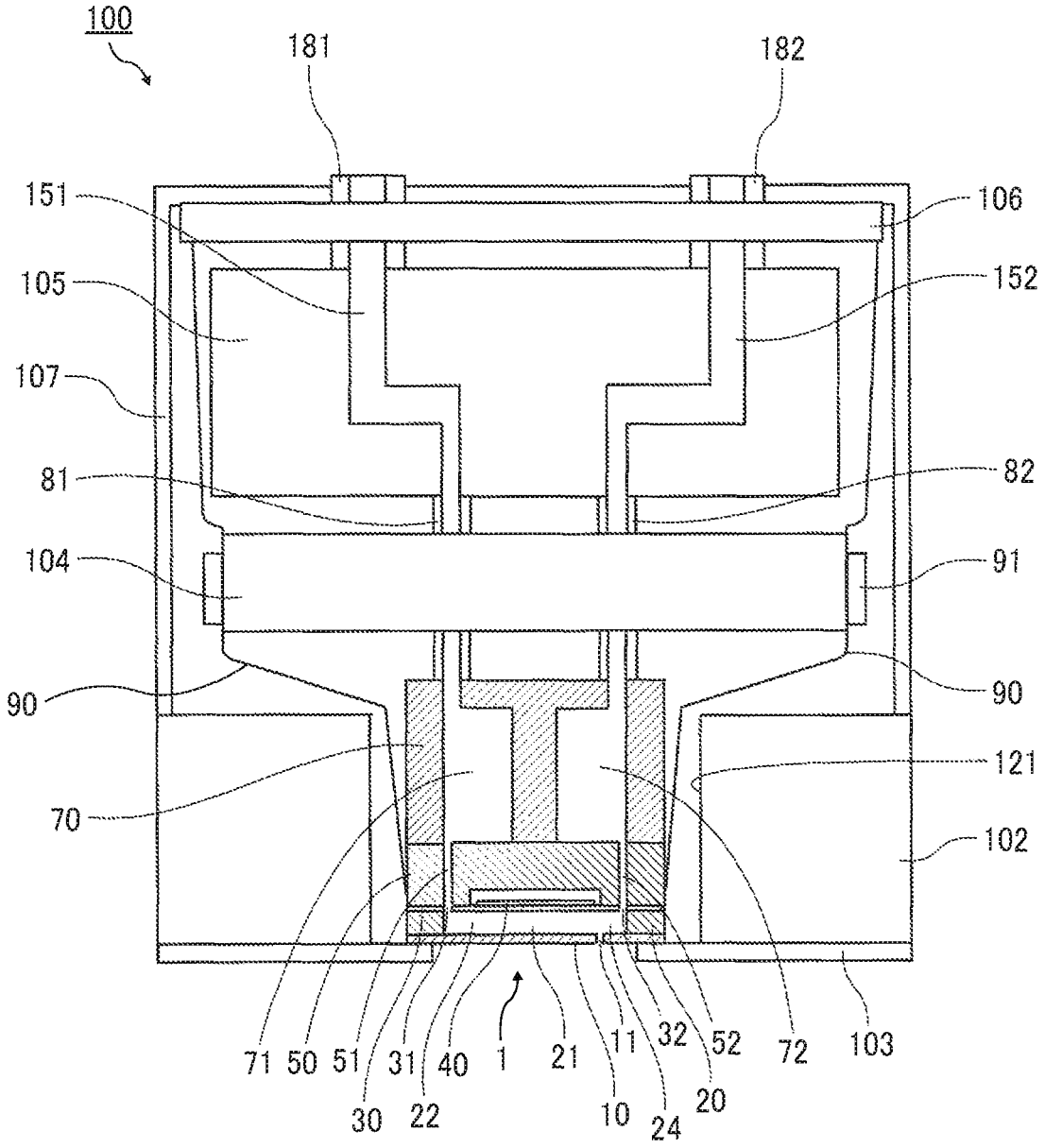
FIG. 1 is a cross-sectional view of a portion of a head module according to a first embodiment in a transverse direction of a liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

In the following, embodiments of the present disclosure are described with reference to the accompanying drawings.

Figure 2:
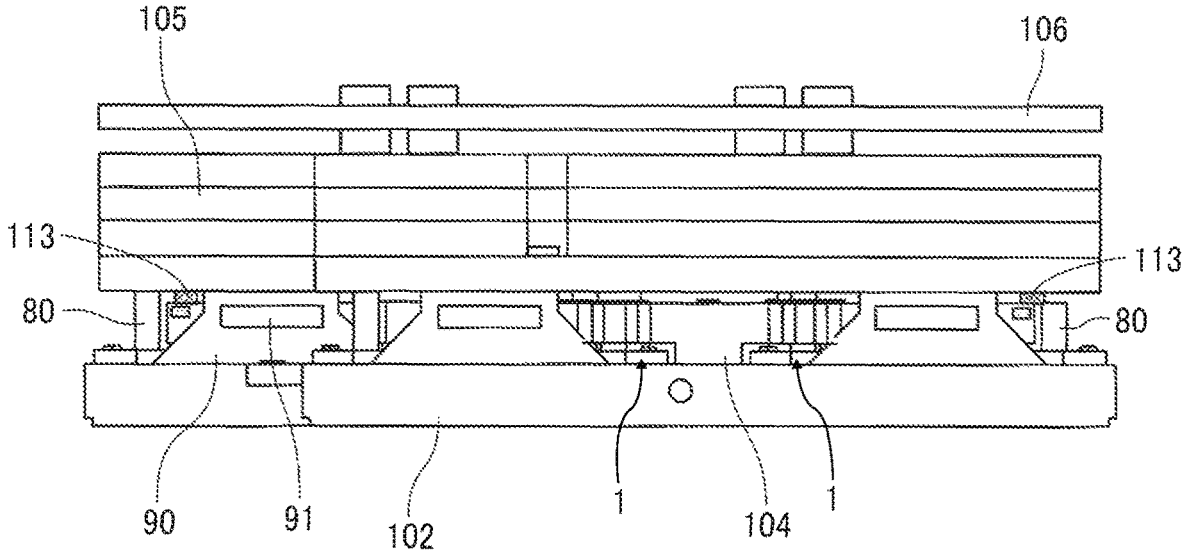
FIG. 2 is a side view of the head module from which a module case is removed according to the first embodiment.
Figure 3:
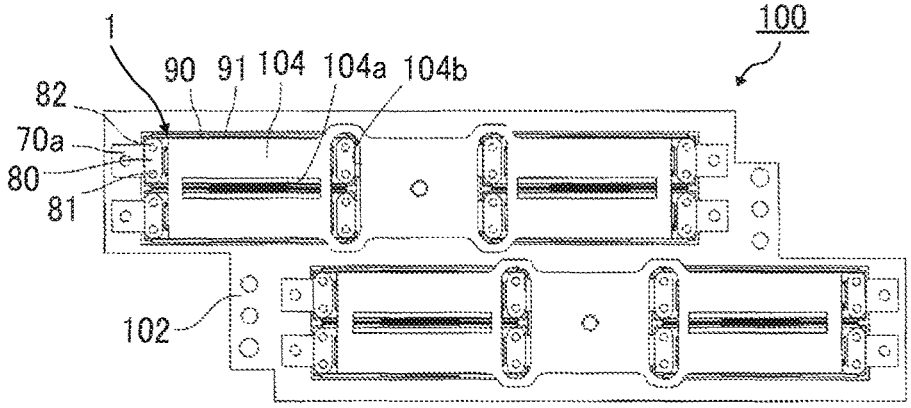
FIG. 3 is an enlarged plan view of the head module as seen from a heat dissipation member.
Figure 5:
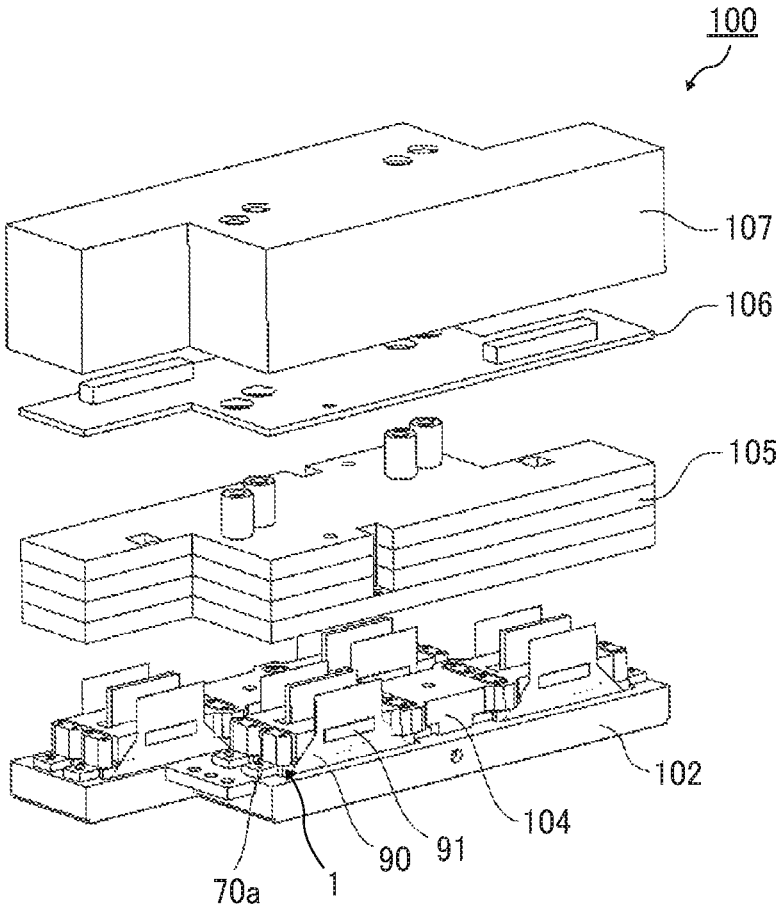
FIG. 5 is an exploded perspective view of the head module.
Figure 6:
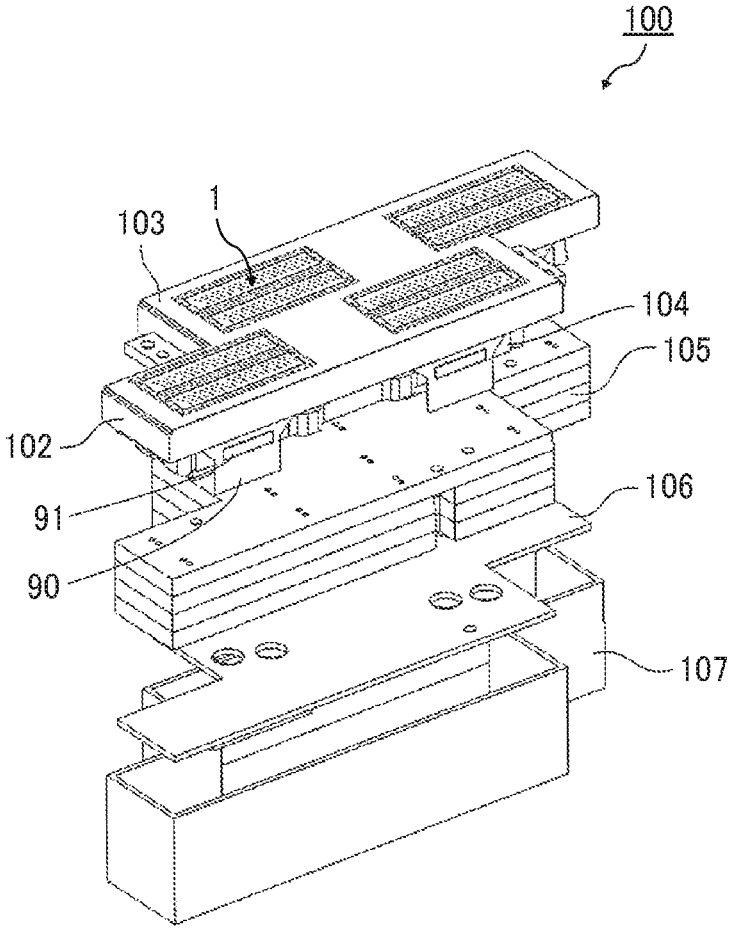
FIG. 6 is an exploded perspective view of the liquid discharge head of FIG. 5 seen from a nozzle surface.
Figure 7:
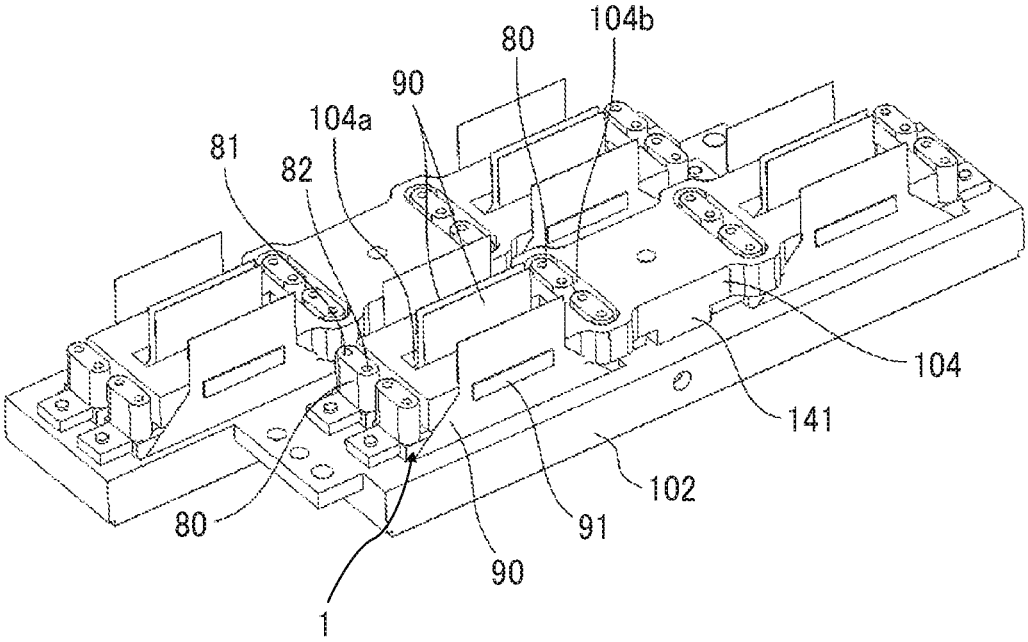
FIG. 7 is a perspective view of the head module as seen from the heat dissipation member.
Figure 8:
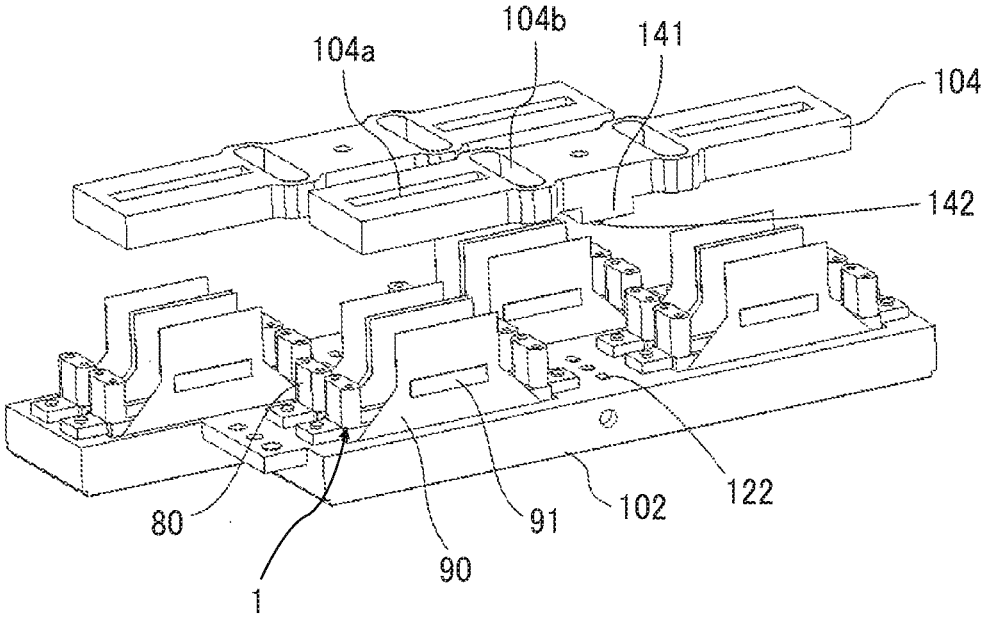
FIG. 8 is an exploded perspective view of the head module as seen from the heat dissipation member.
Figure 9:
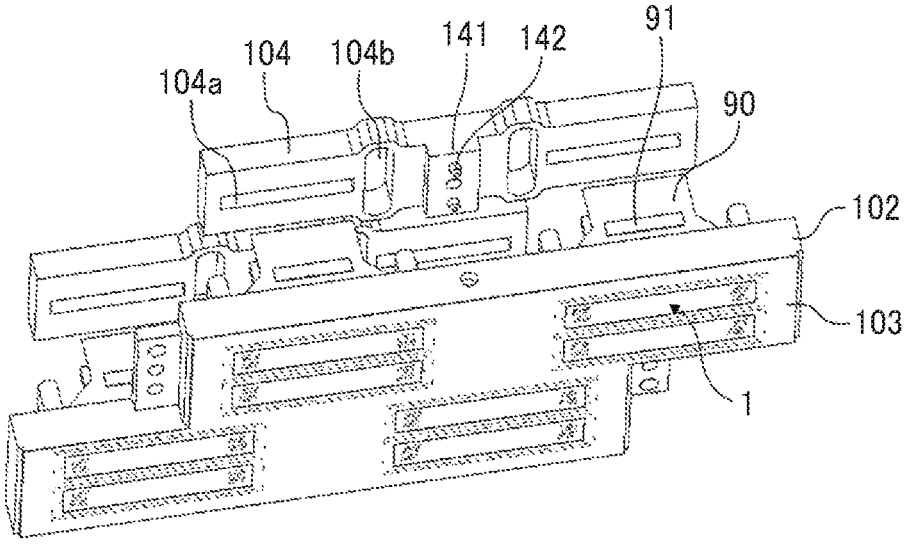
FIG. 9 is an exploded perspective view of the head module as seen from the nozzle surface.
Figure 10:
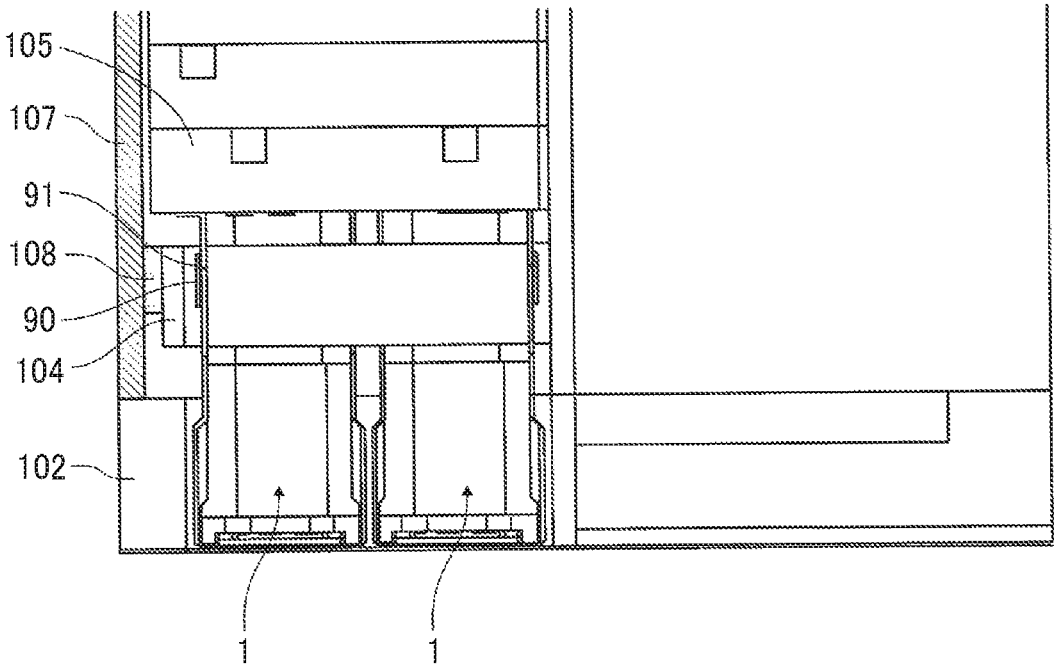
FIG. 10 is an enlarged cross-sectional view of a joint portion between the module case and the heat dissipation member.

A first embodiment of the present disclosure is described with reference to FIGS. 1 to 10. FIG. 1 is a cross-sectional view of a portion of a head module according to the first embodiment in the transverse direction of the liquid discharge head. FIG. 2 is a side view of the head module according to the first embodiment. FIG. 3 is an enlarged plan view of the head module from a radiation member seen from a liquid discharge head side in the first embodiment. FIG. 4 is an enlarged cross-sectional view of a joint portion between a heat dissipation member and a flexible wiring member. FIG. 5 is an exploded perspective view of the head module. FIG. 6 is an exploded perspective view of the head module seen from a nozzle surface. FIG. 7 is a perspective view of the head module of a liquid discharge head side from a radiation member. FIG. 8 is an exploded perspective view of the head module of the liquid discharge head side as seen from the heat dissipation member. FIG. 9 is an exploded perspective view of the head module of the liquid discharge head side as seen from a nozzle surface. FIG. 10 is an enlarged cross-sectional view of a joint portion between a module case and a heat dissipation member. Note that, in FIG. 1, a part of the head module corresponding one of the liquid discharge heads is illustrated.

A head module 100 includes a plurality of liquid discharge heads 1, a base 102, a cover 103, a heat dissipation member 104, a manifold 105, a printed circuit board (PCB) 106, and a module case 107. The "liquid discharge head" 1 is simply referred to as "head". The head 1 discharges liquid from nozzles 11.

The plurality of heads 1 includes a nozzle plate 10, an individual channel plate 20, a diaphragm 30, an intermediate channel plate 50, and a common channel member 70, for example. The nozzle plate 10 includes a nozzle surface in which the nozzles 11 are formed. The individual channel plate 20 includes individual chambers 21 communicating with the nozzles 11, respectively. The diaphragm 30 includes piezoelectric elements 40. The intermediate channel plate 50 is laminated on the diaphragm 30. The common channel member 70 is laminated on the intermediate channel plate 50.

The individual channel plate 20 forms a supply-side individual channel 22 communicating with the individual chamber 21 and a collection-side individual channel 24 communicating with the individual chamber 21 together with the individual chamber 21.

The intermediate channel plate 50 forms a supply-side intermediate individual channel 51 and a collection-side intermediate individual channel 52. The supply-side intermediate individual channel 51 communicates with the supply-side individual channel 22 via an opening 31 of the diaphragm 30. The collection-side intermediate individual channel 52 communicates with the collection-side individual channel 24 via an opening 32 of the diaphragm 30.

The common channel member 70 forms a supply-side common channel 71 and a collection-side common channel 72. The supply-side common channel 71 communicates with the supply-side intermediate individual channel 51. The collection-side common channel 72 communicates with the collection-side intermediate individual channel 52.

The supply-side common channel 71 communicates with an internal channel 151 of the manifold 105 via a supply port 81. The manifold 105 includes a supply port 181 communicating with the internal channel 151. The collection-side common channel 72 communicates with an internal channel 152 of the manifold 105 via a collection port 82. The manifold 105 includes a collection port 182 communicating with the internal channel 152.

The printed circuit board (PCB) 106 and the piezoelectric elements 40 of the head 1 are connected via a flexible wiring member 90 (wiring member), and driver integrated circuits (driver ICs) 91 (drive circuits) are mounted on the flexible wiring member 90. The flexible wiring member 90 is connected to the piezoelectric elements 40 of the head 1. In FIGS. 1, 7, and 8, two flexible wiring members 90 are connected to one head 1.

In the present embodiment, a plurality of heads 1 is mounted onto the base 102 with a space provided between the heads 1. Specifically, as illustrated in FIG. 6, for example, two heads 1 arranged side by side in the transverse direction of the head 1 form one set. Four sets of the heads 1 are arranged in a staggered manner in a longitudinal direction of the head 1. Thus, the head module 100 includes eight heads 1 in FIG. 6.

To attach the head 1 to the base 102, the head 1 is inserted into an opening 121 formed in the base 102. Further, a peripheral portion of the nozzle plate 10 of the head 1 is joined and fixed to the cover 103 joined to the base 102. A flange portion 70*a* provided outside the common channel member 70 of the head 1 is joined and fixed to the base 102.

The particular structure of fixing the head 1 and the base 102 is not limited, and may be formed by adhesion, caulking, and screwing, for example.

Here, the base 102 is preferably formed of a material having a low coefficient of linear expansion. For example, 42 Alloy (alloy) with nickel added to iron or invar material may be used for forming the base 102. In the present embodiment, invar material is used for forming the base 102. Thus, even if the head 1 generates heat so that the temperature of the base 102 increases, a displacement of the nozzles from a predetermined nozzle position does not occur easily since the expansion of the base 102 is small. Thus, the present embodiment can reduce displacement of a landing position of the liquid discharged from the nozzles 11 of the head 1.

The heat dissipation member 104 is disposed facing both the heads 1 (four heads 1 in FIG. 3) and the base 102. Thus, as illustrated in FIG. 3, the heat dissipation member 104 is disposed to overlap with at least one head 1 in plan view. The heat dissipation member 104 is a metal member and is preferably made of material having high thermal conductivity, such as metal containing at least one of aluminum, silver, copper, and gold.

Further, as illustrated in FIGS. 7 through 9, a convex holding portion 141 is provided between two heads 1 adjacent to each other in the longitudinal direction of the head 1. The convex holding portion 141 contacts a surface of the base 102 and is held by the base 102. The base 102 includes concave portions 122. (illustrated in FIG. 8) formed between the plurality of heads 1 adjacent to each other, Specifically, as illustrated in FIGS. 8 and 9, the protrusion 142 formed on a leading end surface of the convex holding portion 141 of the heat dissipation member 104 is fitted into and fixed to the concave portion 122 formed in the base 102. Thus, the convex holding portion 141 of the heat dissipation member 104 is held by the base 102.

In this way, the head module 100 has a configuration in which the heat dissipation member 104 is facing the heads 1 and the base 102 contacts the base 102 at a position between the adjacent heads 1. Thus, the head module 100 of the present embodiment can simplify the structure of holding the heat dissipation member 104 and reduce the size of the heat dissipation member 104.

Further, the heat dissipation member 104 contacts the base 102 across a plane and is held by the base 102. Thus, the posture of the heat dissipation member 104 is stabilized.

As illustrated in FIGS. 8 and 9, positions of fixing portions between the heat dissipation member 104 and the base 102 (positions of the protrusions 142 and the concave portions 122) are located near the longitudinal center of the head 1. Thus, the heat dissipation member 104 contacts the base 102 at a position in a vicinity of a center of the base 102 in a longitudinal direction of the plurality of heads 1.

As a result, the heat dissipation member 104 can extend in the longitudinal direction when the heat dissipation member 104 thermally expands. Thus, the present embodiment can prevent the base 102 from being deformed by the thermal expansion of the heat dissipation member 104.

Conversely, if the heat dissipation member 104 is fixed to the base 102 at a plurality of positions, a force generated by an expansion of the heat dissipation member 104 by heat may act on the base 102 and deform the base 102.

Next, the coupling between the driver IC 91 (drive circuit) and the heat dissipation member 104 is described below with reference to FIG. 4.

Figure 4A:
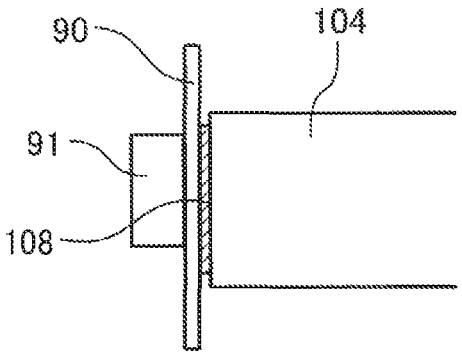
FIGS. 4A and 4B are enlarged cross-sectional views of a joint portion between the heat dissipation member and a flexible wiring member.
Figure 4B:
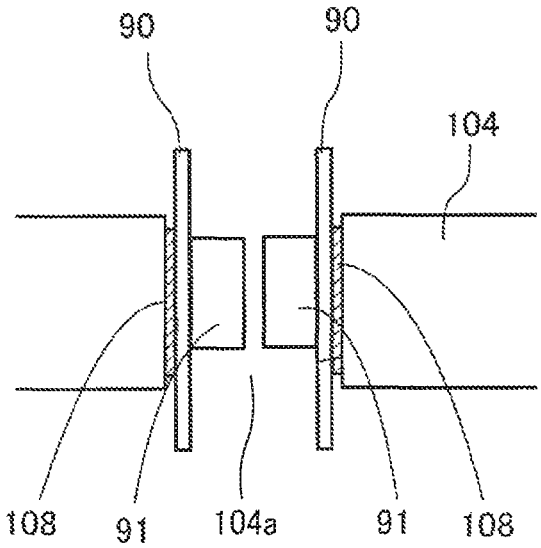

First, as illustrated in FIG. 4A, the flexible wiring member 90, on which the driver IC 91 (drive circuit) is mounted, and the heat dissipation member 104 are fixed together by the heat conductive tape 108. Thus, the driver IC 91 and the heat dissipation member 104 are thermally coupled via the flexible wiring member 90 and the heat conductive tape 108. In the present embodiment, the term "thermally coupled" means that the heat generated by the driver IC 91 is in a state of being thermally conducted to the heat dissipation member 104.

Further, as illustrated in FIGS. 3 and 6 in the present embodiment, the two heads 1 are arranged side by side in the transverse direction of the head 1. Thus, the heat dissipation member 104 includes through-holes 104*a* through which two flexible wiring members 90 of the adjacent heads 1 pass (see FIGS. 7 and 8, for example).

As illustrated in FIGS. 4B and 7 to 9, adjacent flexible wiring members 90 are fixed to wall surfaces of the through-hole 104*a* by the heat conductive tapes 108 in the through-hole 104*a*, respectively. In addition, the driver ICs 91 on the flexible wiring members 90 are thermally coupled to the heat dissipation member 104 by the heat conductive tapes 108.

Thus, two heads 1 of the plurality of heads 1 are arranged on the base 102 in a transverse direction of the plurality of heads 1, and two wiring members 90 of the plurality of wiring members 90 connected to the two heads 1, respectively, pass through the through-hole 104*a* of the heat dissipation member 104. Two drive circuits of the plurality of drive circuits (driver ICs 91) mounted on the two wiring members 90, respectively, are thermally coupled to the heat dissipation member 104 in the through-hole 104*a*.

As illustrated in FIGS. 1 and 5, the module case 107 is attached to the base 102 in the present embodiment. The module case 107 accommodates a part of the flexible wiring member 90 including the printed circuit board (PCB) 106, the manifold 105, the heat dissipation member 104, and the driver IC 91 in the module case 107.

As illustrated in FIG. 10, the heat dissipation member 104 is fixed to and thermally coupled to the module case 107 with a heat conductive member such as the heat conductive tape 108. Heat from the heat dissipation member 104 is radiated outside the head module 100 through the module case 107.

Each of port portions 80 includes the supply port 81 and the collection port 82 of the head 1. As illustrated in FIGS. 3, 7, and 8, some (four in FIG. 7) of the port portions 80 are disposed outside the heat dissipation member 104 in the longitudinal direction of the heat dissipation member 104. Some of the port portions 80 (four in FIG. 7) are disposed inside the through-holes 104*b* and protrude through the through-holes 104*b* formed in the heat dissipation member 104. Each of the heat dissipation members 104 includes two through-holes 104*b* in FIG. 7.

Here, the through-holes 104*b* of the heat dissipation member 104 are larger than the port portions 80, and the port portions 80 and the heat dissipation member 104 are not in contact with each other.

Thus, the present embodiment can reduce an increase in temperature of the liquid caused by the heat of the heat dissipation member 104 directly conducting to the supply port 81 and the collection port 82. Thus, the head module 100 according to the present embodiment can reduce variations in discharge characteristics of the head 1 due to heat generated by the driver IC 91.

Further, the port portion 80 protrudes from an upper surface of the heat dissipation member 104. The manifold 105 is disposed on the port portion 80. Thus, a gap is formed between the manifold 105 and the upper surface of the heat dissipation member 104.

Note that the manifold 105 is held on the heat dissipation member 104 with a partial contact portion 113 (see FIG. 2) provided between the manifold 105 and the heat dissipation member 104. The partial contact portion may be adhesive or a gasket, for example.

The present embodiment can prevent the heat of the heat dissipation member 104 from being conducted to the manifold 105 that increases the temperature of the liquid. Thus, the head module 100 according to the present embodiment can reduce variations in discharge characteristics of the head 1 due to increase in the temperature of the liquid in the head module 100.

Figure 11A:
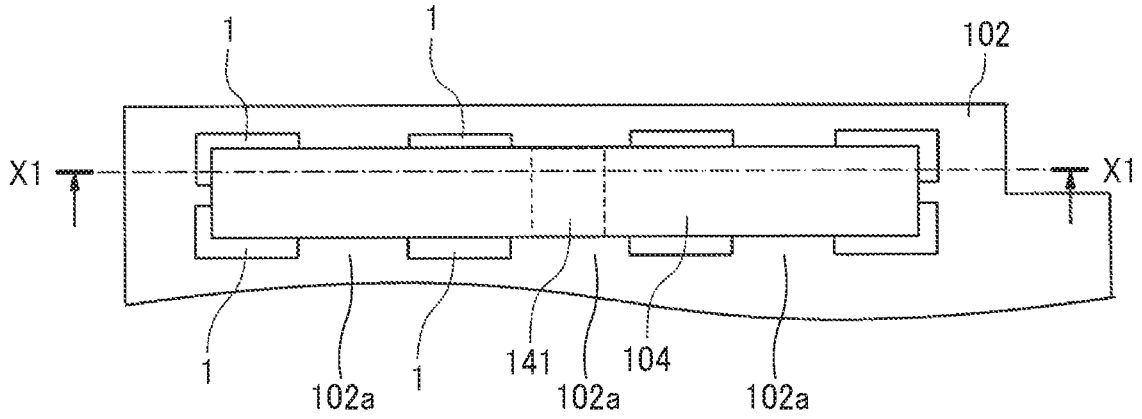
FIGS. 11A and 11B illustrate a contact portion between the base and the heat dissipation member in a second embodiment.
Figure 11B:
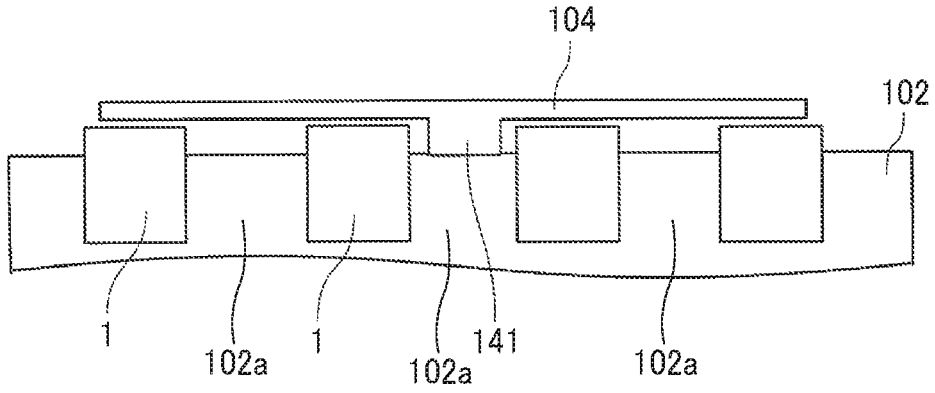

Next, a second embodiment of the present disclosure is described with reference to FIGS. 11A and 11B. FIGS. 11A and 11B illustrate a contact portion between the base 102 and the heat dissipation member 104 in the second embodiment. FIG. 11A is a plan view of the contact portion. FIG. 11B is a cross-sectional view of the contact portion cut along a line X1-X1 in FIG. 11A.

In the present embodiment, four heads 1 are arranged in the base 102 along the longitudinal direction of the base 102. Thus, as illustrated in FIGS. 11A and 11B, there are three spaces 102*a* formed between the heads.

As in the first embodiment, the convex holding portion 141 of the heat dissipation member 104 is provided at one place near the center of the heat dissipation member 104 in an arrangement direction of the heads 1 that is along the longitudinal direction of the head 1. Further, one convex holding portion 141 is held by the base 102 while the one convex holding portion 141 is in contact with the base 102.

In FIGS. 11A and 11B, an even number (four in FIGS. 11A and 11B) of heads 1 are arranged in the longitudinal direction of the head 1, one convex holding portion 141 is formed in the heat dissipation member 104 at a position corresponding to one of the space 102*a* positioned at a center of an odd number (three in FIGS. 11A and 11B) of spaces 102*a* formed between the heads 1. The convex holding portion 141 is held in contact with the base 102.

As a result, the heat dissipation member 104 can extend in the longitudinal direction when the heat dissipation member 104 thermally expands. Thus, the present embodiment can prevent the base 102 from being deformed by the thermal expansion of the heat dissipation member 104.

Figure 12A:
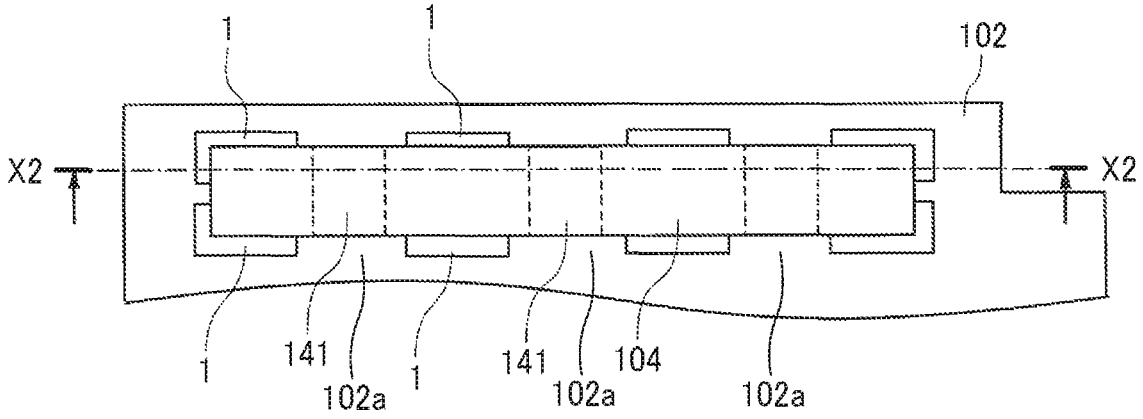
FIGS. 12A and 12B illustrate a contact portion between the base and the heat dissipation member in a third embodiment.
Figure 12B:
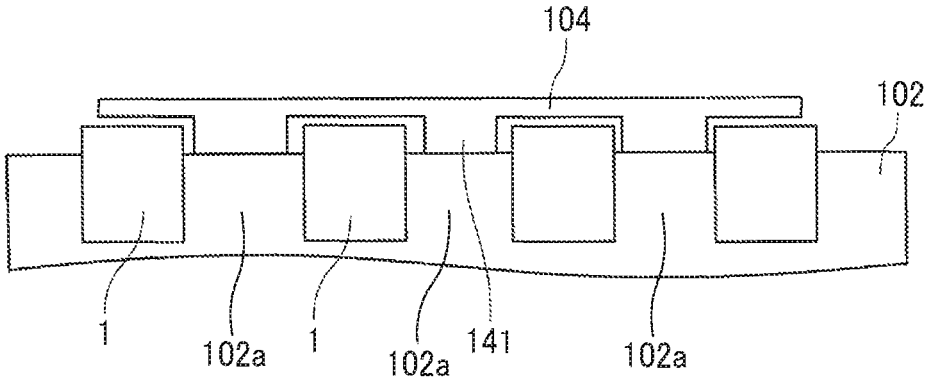

Next, a third embodiment of the present disclosure is described with reference to FIGS. 12A and 12B. FIGS. 12A and 12B illustrate a contact portion between the base 102 and the heat dissipation member 104 in the third embodiment. FIG. 12A is a plan view of the contact portion. FIG. 12B is a cross-sectional view of the contact portion cut along a line X2-X2 in FIG. 12A.

Also in the present embodiment, four heads 1 are arranged in the longitudinal direction of the head 1 in the base 102. Thus, three spaces 102*a* are formed between the heads 1.

In the third embodiment, three convex holding portions 141 are formed in the heat dissipation member 104 at positions corresponding to three spaces 102*a* of the base 102 formed between the heads 1 in the arrangement direction of the heads 1 that is along the longitudinal direction of the head 1. Further, the three convex holding portions 141 are held in contact with the base 102.

In a configuration as described in the third embodiment, the base 102 is preferably formed of a member having rigidity that does not deform when the heat dissipation member 104 thermally expands.

Figure 13:
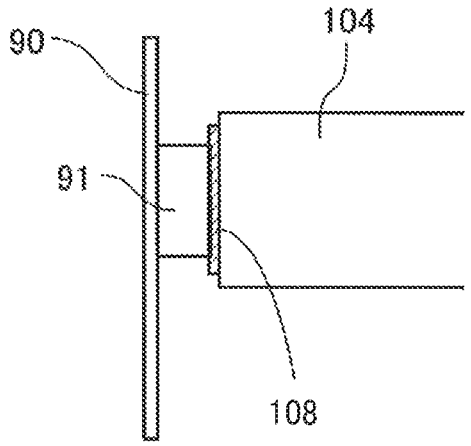
FIG. 13 is an enlarged cross-sectional view of a connection portion between the heat dissipation member and the driver IC (drive circuit) in a fourth embodiment.

Next, a fourth embodiment of the present embodiment is described below with reference to FIG. 13. FIG. 13 is an enlarged cross-sectional view of a connection portion between the heat dissipation member 104 and the driver IC 91 (drive circuit) in the fourth embodiment.

In the present embodiment, the driver IC 91 and the heat dissipation member 104 are fixed together by the heat conductive tape 108, and the driver IC 91 and the heat dissipation member 104 are thermally joined.

Figure 14:
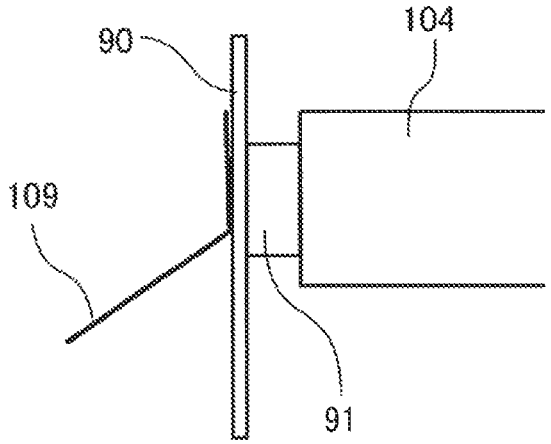
FIG. 14 is an enlarged cross-sectional view of a connection portion between the heat dissipation member and the driver IC (drive circuit) in a fifth embodiment.

Next, a fifth embodiment of the present embodiment is described with reference to FIG. 14. FIG. 14 is an enlarged cross-sectional view of a connection portion between the heat dissipation member 104 and the driver IC 91 (drive circuit) in the fifth embodiment.

In the present embodiment, the driver IC 91 is pressed against the heat dissipation member 104 by an elastic member 109 such as a spring from the side of the flexible wiring member 90 to thermally couple the driver IC 91 and the heat dissipation member 104. In the fifth embodiment, silicon grease or the like having high thermal conductivity may be preferably applied between the driver IC 91 and the heat dissipation member 104.

Figure 15:
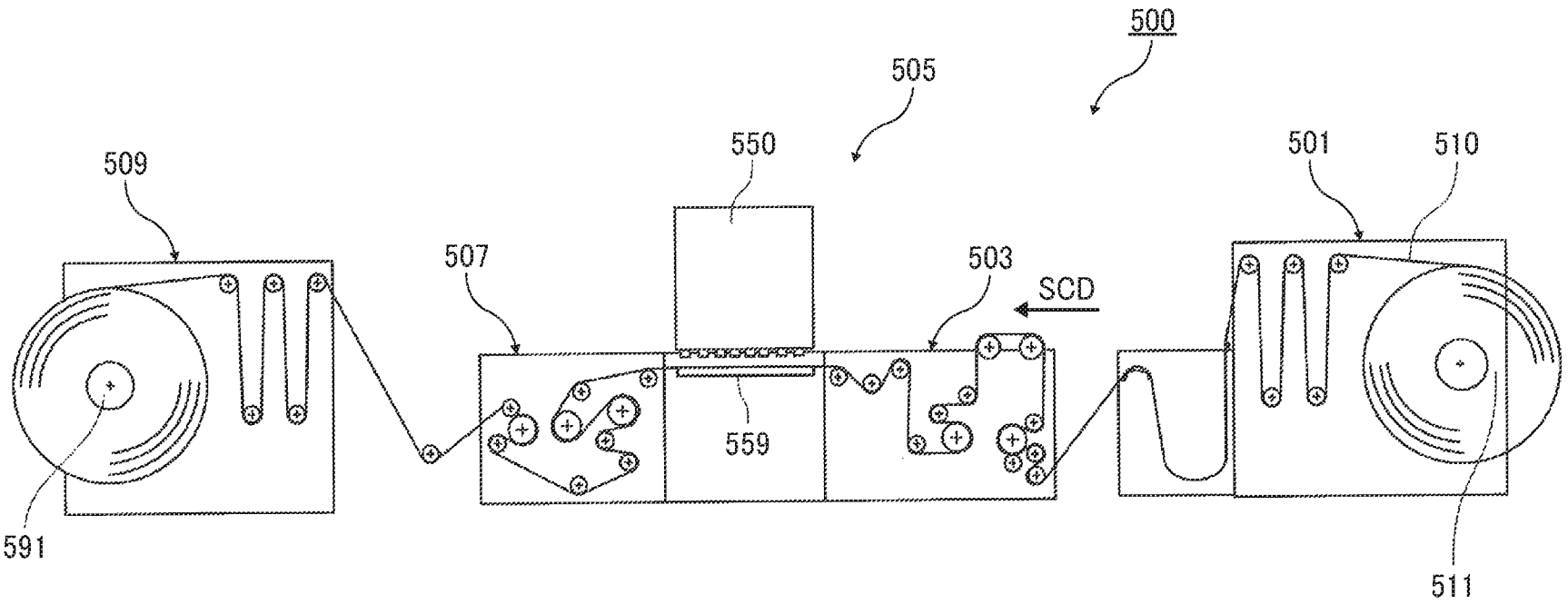
FIG. 15 is an illustration of the liquid discharge apparatus according to the present disclosure.
Figure 16:
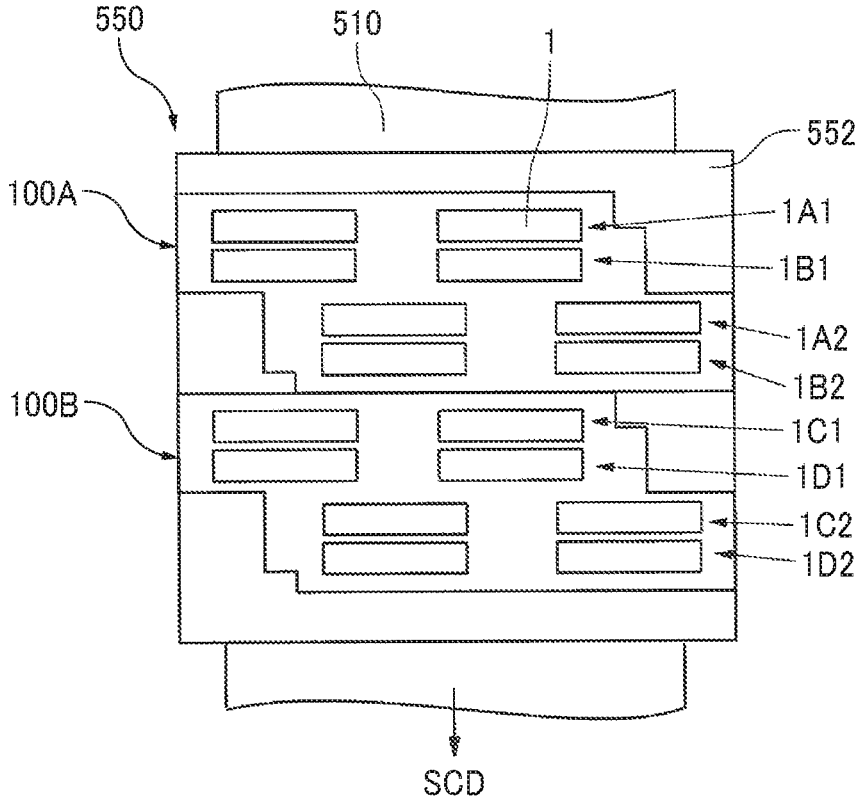
FIG. 16 is a plan view of a head unit of the liquid discharge apparatus of FIG. 15.

Next, a liquid discharge apparatus according to an embodiment of the present disclosure is described with reference to FIGS. 15 and 16. FIG. 15 is a side view of the liquid discharge apparatus according to the present embodiment. FIG. 16 is a plan view of a head unit of the liquid discharge apparatus of FIG. 15 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a head unit 550 on a conveyance guide 559. The head unit 550 discharges liquid to form an image on the continuous medium 510.

Here, as illustrated in FIG. 16, the head unit 550 includes two head modules 100A and 100B disposed on a common base 552.

The head unit 550 includes a head module 1001 and a head module 100B. The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The conveyance direction of the continuous medium 510 is indicated by arrow SCD in FIGS. 15 and 16.

The head module 100B includes head arrays 1C1, 1D1, 1C2, and 1D2. Each of the head arrays 1C1, 1D1, 1C2, and 1D2 includes a plurality of heads 1 arranged in a direction perpendicular to a conveyance direction of the continuous medium 510. An arrangement direction of the heads 1 of the head modules 100A and 100B is perpendicular to a conveyance direction of the continuous medium 510. The "arrangement direction of the heads" is also referred to as a "head arrangement direction".

The head arrays 1A1 and 1A2 of the head module 100A are grouped as one set that discharge liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquids of the same color.

The head module according to the present embodiment can be formed together with functional parts and mechanisms as a single unit (integrated unit) to constitute a liquid discharge device. For example, at least one of the configurations of the head module 100, a head tank, a carriage, a supply mechanism, a maintenance unit, a main scan moving unit, and the liquid circulation device may be combined together to form the liquid discharge device.

Examples of the integrated unit include a combination in which the head module and one or more functional parts and devices are secured to each other through, e.g., fastening, bonding, or engaging, and a combination in which one of the head and the functional parts and devices is movably held by another. Further, the head module 100, the functional parts, and the mechanism may be configured to be detachable from each other.

The term "liquid discharge apparatus" used herein is an apparatus including the head module 100, or a liquid discharge device to discharge liquid by driving the liquid discharge head 1. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material on which liquid adheres" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material onto which liquid adheres" may be any material as long as liquid can at least temporarily adhere to the material, such as paper, thread, fiber, cloth, leather, metal, plastic, glass, wood, ceramics, or the like.

The "liquid discharge apparatus" may be an apparatus to relatively move the liquid discharge head and a material on which liquid can be adhered. However, the liquid discharge apparatus is not limited to such an apparatus. For example, the "liquid discharge apparatus" may be a serial head apparatus that moves the liquid discharge head, a line head apparatus that does not move the liquid discharge head, or the like.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

Liquid to be discharged from the nozzle of the liquid discharge head is not limited to any particular liquid as long as the liquid has a viscosity or surface tension that allows the liquid to be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A head module, comprising:

a base;

a plurality of heads mounted on the base;

a plurality of wiring members connected to the plurality of heads, the plurality of wiring members respectively mounting a plurality of drive circuits; and a heat dissipation member thermally coupled to the plurality of drive circuits, the heat dissipation member disposed facing the plurality of heads and contacting the base, the heat dissipation member contacting two or more heads of the plurality of heads.

2. The head module of claim 1, wherein the heat dissipation member contacts the base across a plane.

3. The head module of claim 1, wherein a coefficient of linear expansion of the base is relatively smaller than a coefficient of linear expansion of the heat dissipation member.

4. The head module of claim 1, further comprising a case, to accommodate at least the heat dissipation member, wherein the heat dissipation member is thermally coupled to the case.

5. The head module of claim 1, wherein the heat dissipation member includes a through-hole through which the plurality of wiring members pass, and wherein the plurality of drive circuits of the plurality of wiring members are thermally coupled to the heat dissipation member in the through-hole.

6. The head module of claim 5, wherein two heads of the plurality of heads are arranged on the base, in a direction transverse of the plurality of heads, wherein two wiring members of the plurality of wiring members, respectively connected to the two heads, pass through the through-hole of the heat dissipation member, and wherein two drive circuits of the plurality of drive circuits, respectively mounted on the two wiring members, are thermally coupled to the heat dissipation member in the through-hole.

7. The head module of claim 1, wherein the base is an alloy including at least iron and nickel.

8. The head module of claim 1, wherein the heat dissipation member includes at least one of aluminum, copper, silver, and gold.

9. The head module of claim 1, wherein each head of the plurality of heads is configured to discharge a liquid.

10. The head module of claim 9, further comprising a manifold including a channel communicating with a channel in the plurality of heads, wherein the manifold faces an upper surface of the heat dissipation member across a gap.

11. A liquid discharge apparatus comprising the head module of claim 9.

12. The head module of claim 1, wherein the heat dissipation member is configured to dissipate heat for two or more heads, of the plurality of heads.

13. The head module of claim 1, wherein the heat dissipation member contacts the base at a position between adjacent heads of the plurality of heads.

14. A head device comprising a plurality of head modules, including the head module of claim 1, arranged on a common base.

15. A head module comprising:

a base;

a plurality of heads mounted on the base;

a plurality of wiring members connected to the plurality of heads, the plurality of wiring members respectively mounting a plurality of drive circuits; and a heat dissipation member thermally coupled to the plurality of drive circuits, the heat dissipation member disposed facing the plurality of heads and facing the base, and the heat dissipation member contacting the base at a position between adjacent heads of the plurality of heads, wherein:

the heat dissipation member includes a convex holding portion and a protrusion on a leading end surface of the convex holding portion, the base includes a concave portion between the adjacent heads of the plurality of heads, and the protrusion of the heat dissipation member is fitted into the concave portion of the base such that the convex holding portion of the heat dissipation member is held by the base.

16. The head module of claim 15, wherein the plurality of heads is arranged on the base in a longitudinal direction of the plurality of heads, and wherein the heat dissipation member, disposed on the base, faces the plurality of heads without contacting the plurality of heads.

17. The head module of claim 15, wherein the heat dissipation member contacts the base at a position in a vicinity of a center of the base in a longitudinal direction of the plurality of heads.

18. A head module, comprising:

a base;

a plurality of heads mounted on the base;

a plurality of wiring members connected to the plurality of heads, the plurality of wiring members respectively mounting a plurality of drive circuits; and a metal member thermally coupled to the plurality of drive circuits, the metal member disposed facing the plurality of heads contacting the base, and the metal member contacting two or more heads of the plurality of heads.

19. The head module of claim 18, wherein the metal member includes a through-hole through which the plurality of wiring members pass, and wherein the plurality of drive circuits of the plurality of wiring members are thermally coupled to the metal member in the through-hole.

20. The head module of claim 19, wherein two heads of the plurality of heads are arranged on the base, in a direction transverse of the plurality of heads, wherein two wiring members of the plurality of wiring members, respectively connected to the two heads, pass through the through-hole of the metal member, and wherein two drive circuits of the plurality of drive circuits, respectively mounted on the two wiring members, are thermally coupled to the heat dissipation member in the through-hole.

21. The head module of claim 18, wherein the metal member is configured to dissipate heat for two or more heads, of the plurality of heads.

22. The head module of claim 18, wherein the metal member is made of material having high thermal conductivity.

23. The head module of claim 18, wherein the metal member contains at least one of aluminum, silver, copper, and gold.

24. The head module of claim 18, wherein the heat dissipation member contacts the base at a position between adjacent heads of the plurality of heads.

25. A head device comprising a plurality of head modules, including the head module of claim 18, arranged on a common base.

26. A liquid discharge apparatus comprising the head device of claim 25, wherein each head of the plurality of heads is configured to discharge a liquid.

* * * * *